US006981783B2

(12) United States Patent
Kao

(10) Patent No.: US 6,981,783 B2
(45) Date of Patent: Jan. 3, 2006

(54) BURGLAR ALARM LIGHT

(75) Inventor: Eric Kao, Taoyuan Hsien (TW)

(73) Assignee: Everspring Industry Co., Ltd., Taoyuan Hsien (TW)

( * ) Notice: Subject to any disclaimer, the term of this patent is extended or adjusted under 35 U.S.C. 154(b) by 208 days.

(21) Appl. No.: 10/615,868

(22) Filed: Jul. 10, 2003

(65) Prior Publication Data

US 2005/0012634 A1 Jan. 20, 2005

(51) Int. Cl.
*F21V 21/00* (2006.01)

(52) U.S. Cl. ..... 362/285; 362/147; 362/188; 362/289; 362/372

(58) Field of Classification Search ..... 362/147, 362/188, 226, 285, 289, 372, 399, 418, 508, 362/266

See application file for complete search history.

(56) References Cited

U.S. PATENT DOCUMENTS 5,017,327 A * 5/1991 Bamber ..... 362/289
5,379,204 A * 1/1995 Paterson ..... 362/285
6,390,649 B1 * 5/2002 Tang ..... 362/285

* cited by examiner

*Primary Examiner*—Thomas M. Sember
*Assistant Examiner*—Jacob Y. Choi
(74) *Attorney, Agent, or Firm*—Birch, Stewart, Kolasch & Birch, LLP

(57) ABSTRACT

A burglar alarm light includes a shell, a lamp set located in the shell, and a shade coupled on the front end of the shell. The shell further has an adjustment mechanism located therein to adjust the displacement of the lamp set thereby to alter light projection type (converging or scattering) emitted from a light source.

10 Claims, 4 Drawing Sheets

BURGLAR ALARM LIGHT

FIELD OF THE INVENTION

The present invention relates to improve the traditional burglar alarm light for an inventive mechanical design of an adjustable lamp set displacement inside the lamp shell. It is easy and cost effective for the user to alter the light projection type for either converging or scattering result on one single lighting fixture.

BACKGROUND OF THE INVENTION

Projection light is a common security apparatus used in residences and high rise buildings. It is usually installed on the entrance and exit of people or vehicles. The projection light normally is turned off. When vehicles, people or moving objects approach the entrance or exit, the sensor in the projection light will actuate the circuits in the projection light to turn on the projection light. It can scare off intruders and provide illumination function. It is widely used in the security facilities.

However, conventional projection light generally is installed on a high location to secure the most desirable projection angle and scope. To install the projection light, users have to climb a ladder to a higher location to fasten the projection light, then descend to the floor to check whether the projecting scope is proper. If the projection scope and angle are not desirable, users have to climb up again to make adjustment or change the installation location and projection angle. The installation task is cumbersome. Moreover, when users want to change the installation of the projection light, as the conventional projection light has a fixed projection focus, the installation location or projection scope cannot be changed at will. A new set of projection light has to be purchased. It is inconvenient to install or replace, and not economical.

SUMMARY OF THE INVENTION

Therefore the primary object of the invention is to resolve the aforesaid disadvantages and to avoid the drawbacks of the prior art. The invention has an adjustment mechanism in the projection light to adjust the displacement of the lamp set thereby to alter light projection type (converging or scattering) emitted from a light source.

In order to achieve the foregoing object, the burglar alarm light of the invention includes a shell, a lamp set housed in the shell and a shade coupled on the front end of the shell. An adjustment mechanism is installed in the shell to adjust the location of the lamp set thereby to change light projection type (converging or scattering) emitted from a light source.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
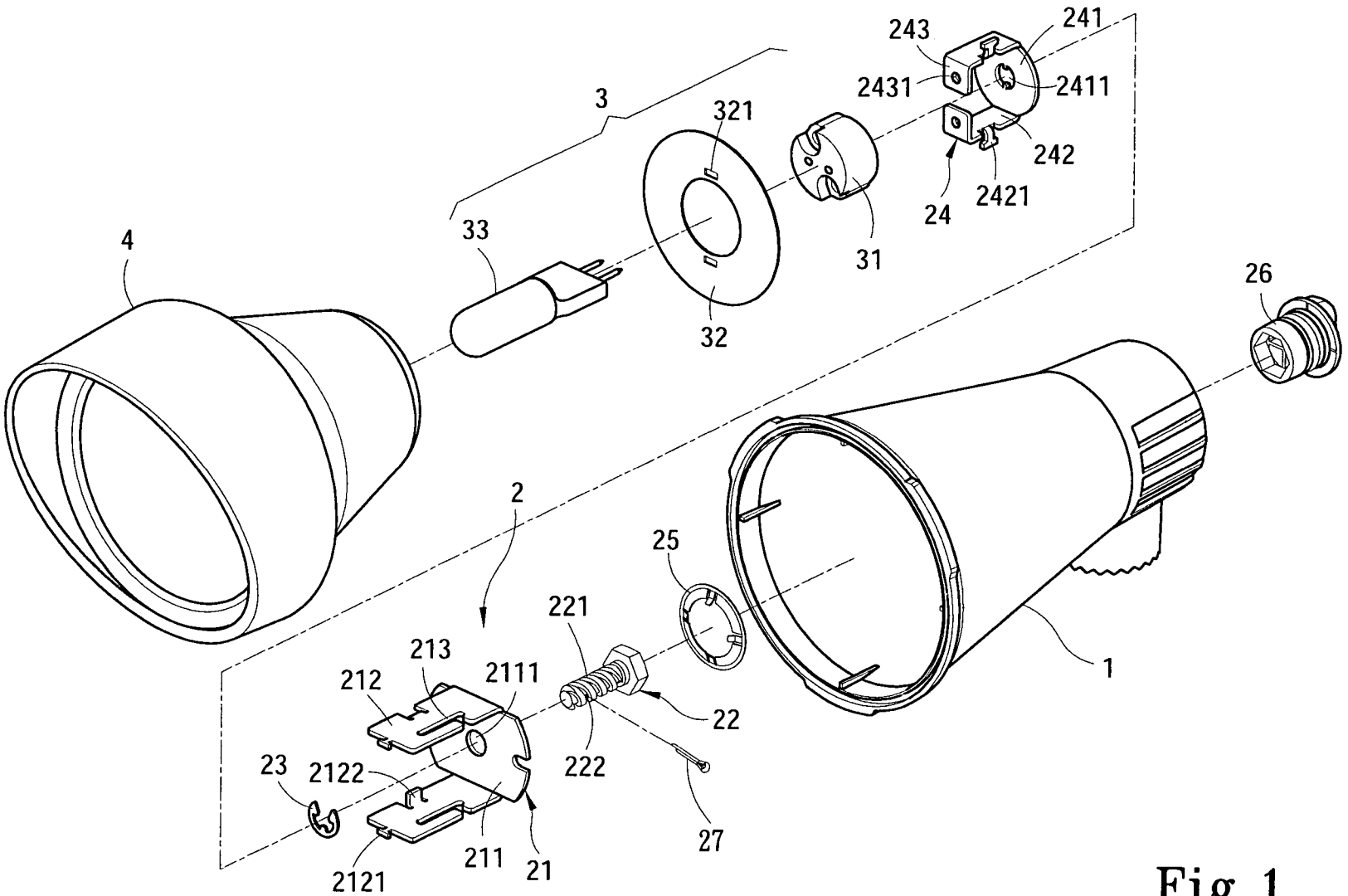
FIG. 1 is an exploded view of the invention.
Figure 2:
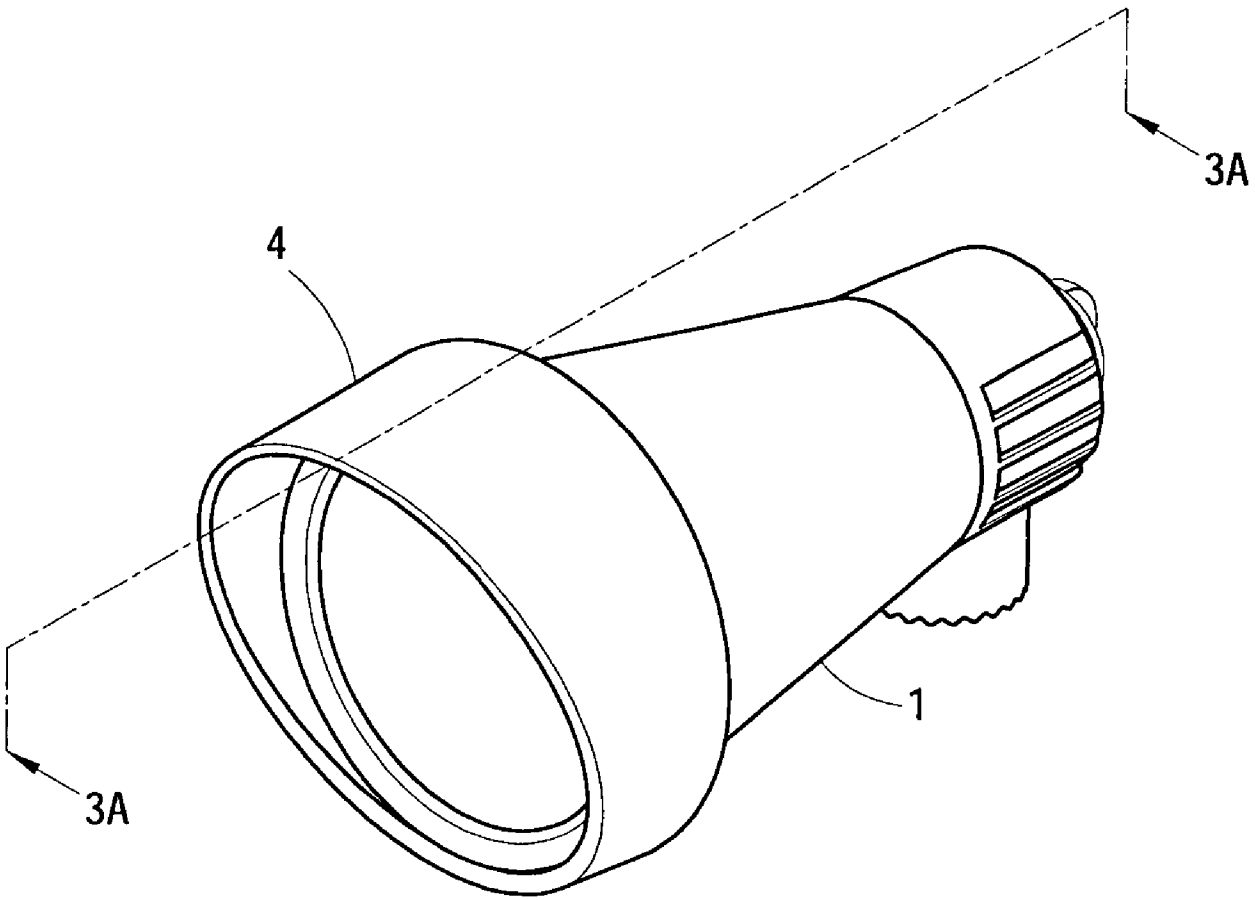
FIG. 2 is a perspective view of the invention.

Referring to FIGS. 1, 2, 3A and 3B, the burglar alarm light of the invention includes a shell 1, a lamp set 3 located in the shell 1, and a shade 4 coupled on the front end of the shell 1. The shell 1 further has an adjustment mechanism 2 located therein to adjust the displacement of the lamp set 3 thereby to alter light projection type (converging or scattering).

The shell 1 is to house the adjustment mechanism 2 and the lamp set 3. The shade 4 is coupled on the front end of the shell 1.

The adjustment mechanism 2 includes a seat 21. The seat 21 has a bottom section 211 which has an aperture 2111 formed thereon. The bottom section 211 has two opposing ends extending upwards to form respectively a first extended section 212. The first extended section 212 has an operation slot 213, and a first lug 2121 on the periphery and a second lug 2122 extending inwards. The seat 21 further is coupled with a rotary member 22 (being a screw in the drawings). The rotary member 22 has screw threads 221 and a hole 222. In addition, the rotary member 22 runs through the aperture 2111 on the bottom section 211 and is coupled with a first retaining member 23 (being a C-shaped clip ring in the drawings) to confine on the bottom section 211 of the seat 21. The hole 222 is coupled with a second retaining member 27 (being a pin in the drawings). The rotary member 22 has one end coupling with a moving member 24. The moving member 24 has a bottom 241 which has a hole 2411 to receive the rotary member 22. The bottom 241 of the moving member 24 has two opposing ends extended upwards to form respectively a first arm 242. Each first arm 242 has a guiding member 2421 movable in the operation slot 213 of the seat 21. In addition, the first arm 242 has one end extended inwards to form a second arm 243. The second arm 243 has an anchor hole 2431. The rotary member 22 has other end to couple with an anchor member 25. The anchor member 25 is wedged coupled with an adjusting member 26 which engages with the rotary member 22 in the shell 1. The adjusting member 26 is turnable by users by a force, such as turned by user's fingers or having a hole on one end to engage with a hand tool or a coin for turning.

The lamp set 3 includes a socket 31, a spacer 32 and a lamp bulb 33 mounted onto the socket 31. The socket 31 is fastened to the anchor hole 2431 of the moving member 24 through a fastener (such as screw). The spacer 32 is an annular ring to allow the socket 31 and the lamp bulb 33 to pass through. The spacer 32 has two holes 321 to couple with the first lug 2121 of the seat 21. The spacer 32 has heat insulation effect, and may guide the lamp bulb 33 when the lamp set 3 is moved.

The shade 4 has a reflective mirror 41 to converge light emitted from the lamp bulb 33 and project the reflected light to a desired location.

When in use, users turn the adjusting member 26. As the adjusting member 26 is connected to the rotary member 22, the rotary member 22 is driven and rotates. And the screw threads 221 of the rotary member 22 push the moving member 24 forwards or rearwards horizontally. As the moving member 24 is fastened to the socket 31 which in turn is coupled with the lamp bulb 33, thus turning of the rotary member 22 will move the socket 31, lamp bulb 33 and moving member 24 horizontally to achieve the object of adjusting the focal distance of light.

Figure 3A:
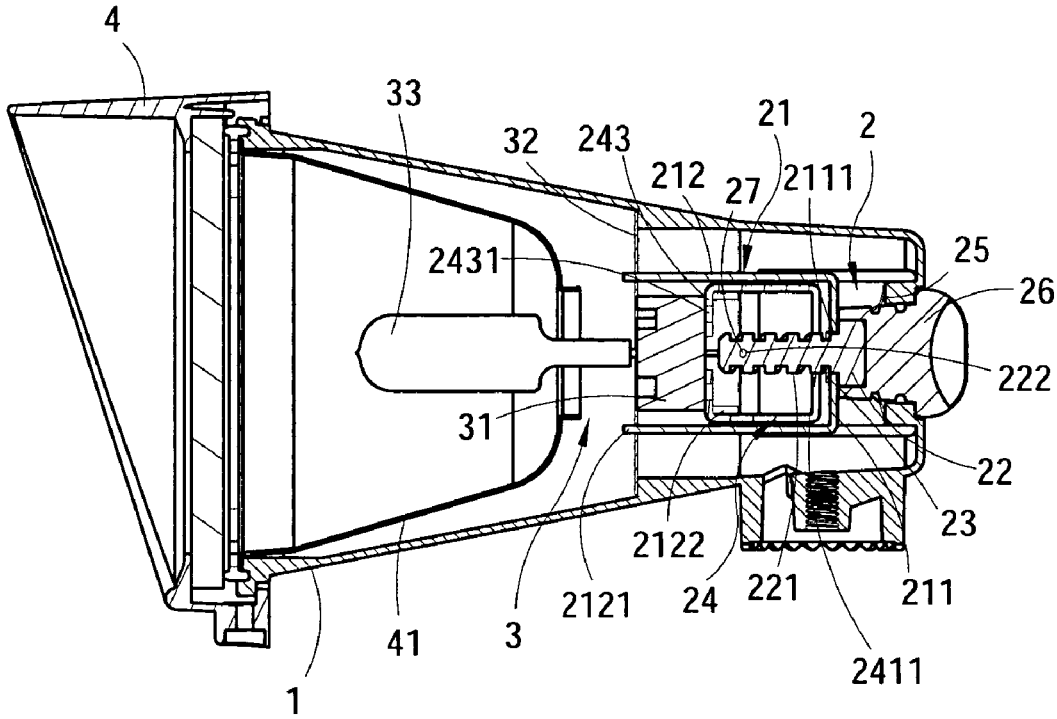
FIG. 3A is a cross section taken on line 3A—3A in FIG. 2.
Figure 3B:
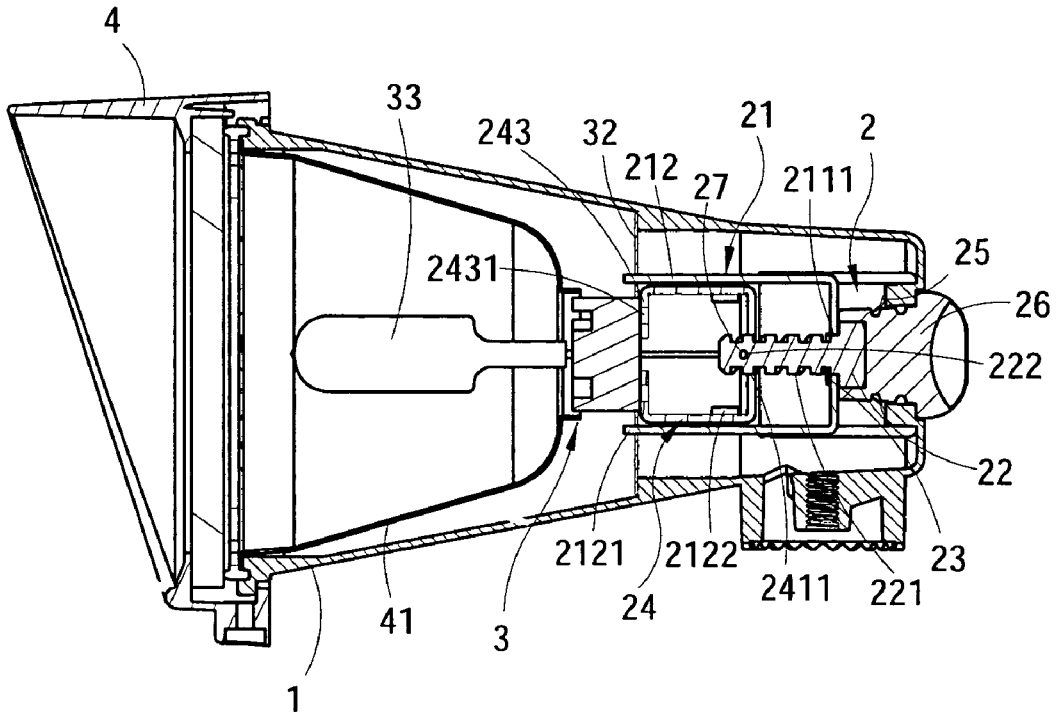
FIG. 3B is a sectional view of an operating condition according to FIG. 3A.

Referring to FIGS. 3A and 3B, when users want to adjust the focal length closer, the rotary member 22 may be turned in one direction and moved rearwards, and move the lamp bulb 33 closer to the reflective mirror 41 of the shade 4 to achieve light converging effect. When the moving member 24 is moved closer to the bottom section 211 of the seat 21, the first retaining member 23 is bucking against the moving member 24 to prohibit the moving member 24 form moving continuously.

On the other hand, when users want to adjust the focal distance of the light farther away, the rotary member 22 may be turned in reverse direction to move the lamp bulb 33 away from the reflective mirror 41 of the shade 4 at a longer distance to achieve light scattering effect. When the moving member 24 is moved away horizontally from the rotary member 22, the second retaining member 27 is bucking against the bottom 241 of the moving member 24 to prohibit the moving member 24 from escaping the rotary member 22.

Figure 4:
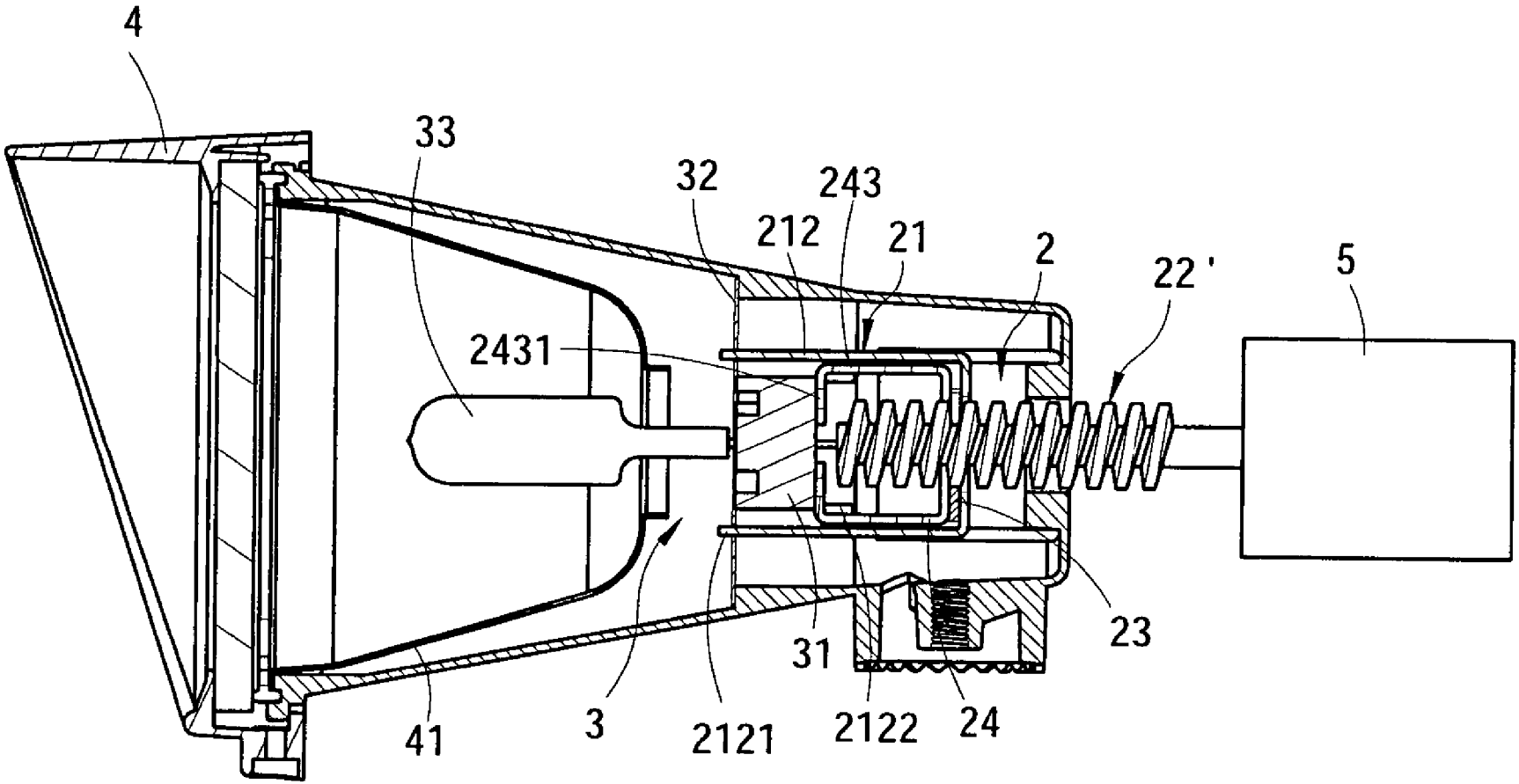
FIG. 4 is a schematic view of another embodiment of the invention adopted for the head light of a car.

Moreover, aside from manually adjusting the focal distance of the light, adjustment of the focal distance of the light may also be accomplished electrically so that the invention may be coupled with projection lights that have various actuators. Refer to FIG. 4 for another embodiment of the invention adopted for use on a car light. As shown in the drawing, the invention is coupled with an actuator 5 on the head light of a car. The main difference from FIG. 3A is that the rotary member 22 is replaced by a worm 22' which has one end connecting to the actuator 5. The actuator 5 may be a motor, server motor, or the like. The actuator 5 may drive the worm 22' to rotate, thereby drivers can adjust the projection focal distance of the head light as desired.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A burglar alarm light comprising a shell, a lamp set located in the shell, a shade coupled on a front end of the shell, and an adjustment mechanism located in the shell to adjust displacement of the lamp set, wherein the adjustment mechanism includes:

a seat having a bottom section which has an aperture formed thereon and two opposing ends extending upwards to form respectively a first extended section, the first extended section having an operation slot;

a moving member located in the seat having a bottom which has a hole and two opposing ends extended upwards to form respectively a first arm, the first arm having a guiding member; and a rotary member running through the bottom section of the seat and the bottom of the moving member;

wherein the adjustment mechanism adjusts the displacement of the lamp set to alter projection type of light, including converging or scattering, emitted by a light source, wherein the first extended section of the seat has a first lug on the periphery thereof and a second lug extending inwards.

2. The burglar alarm light of claim 1, wherein the first arm of the moving member has one end extended inwards to form a second arm.

3. The burglar alarm light of claim 2, wherein the second arm has an anchor hole.

4. The burglar alarm light of claim 1, wherein the rotary member has screw threads.

5. The burglar alarm light of claim 1, wherein the rotary member is selectively a screw or a worm.

6. The burglar alarm light of claim 1, wherein the adjustment mechanism has a first retaining member to confine the rotary member on the seat.

7. The burglar alarm light of claim 1, wherein the adjustment mechanism has an adjusting member coupled on the rotary member to drive and rotate the rotary member.

8. The burglar alarm light of claim 1, wherein the adjustment mechanism has an anchor member to anchor the adjustment member on the shell.

9. The burglar alarm light of claim 1, wherein the lamp set includes a socket, a spacer and a lamp bulb.

10. The burglar alarm light of claim 1, wherein the shade includes a reflective mirror.

* * * * *